United States Patent [19]

Perez

[11] 4,019,771

[45] Apr. 26, 1977

[54] RELEASABLE CONNECTOR HAVING IMPROVED LOAD CARRYING AND RELEASING CAPABILITY

[75] Inventor: George R. Perez, Alexandria, Va.

[73] Assignee: AMF Incorporated, White Plains, N.Y.

[22] Filed: May 20, 1976

[21] Appl. No.: 688,215

[52] U.S. Cl. ..... 294/83 R; 24/230 AP; 294/83 AB

[51] Int. Cl.[2] ..... B66C 1/34

[58] Field of Search ..... 294/66 R, 83 R, 83 A, 294/83 AB, 83 AE, 75, 84; 24/73 HR, 230 A, 230 TC, 230 AP, 230 AS, 230 AV; 114/206 R

[56] References Cited

UNITED STATES PATENTS

| | | | |
|---|---|---|---|
| 2,868,581 | 1/1959 | Minty et al. | 294/83 AB |
| 2,904,369 | 9/1959 | Campbell | 294/83 AB |
| 2,981,074 | 4/1961 | Wilder | 294/83 R |
| 3,602,959 | 9/1971 | Perez | 24/230 AP |
| 3,848,226 | 11/1974 | Perez | 294/83 AE X |

*Primary Examiner*—Johnny D. Cherry
*Attorney, Agent, or Firm*—George W. Price; John H. Gallagher

[57] ABSTRACT

A releasable connector mechanism having two parallel side plates and first and second shafts extending between the plates on opposite sides thereof. At least one of the shafts is freely rotatable and has a pair of spaced pivot arms attached thereto. The rotatable shaft has a groove or cam surface extending longitudinally along its surface.

A load carrying fulcrum plate having a concave cylindrical pivot surface not more than 180° on one end thereof is inserted between the side plates with the pivot surface supported on the nonrotating shaft. The other end of the fulcrum plate has a swinging latch attached thereto which pivotally contacts the other end of the fulcrum plate and also pivotally contacts the cam or groove in the rotatable shaft.

In its set condition the fulcrum plate is held between the side plates by the nonrotatable shaft and by the swinging latch. Upon rotation of the rotatable shaft by means of a release mechanism and pivot arms, the shaft rotates and the swinging latch falls away from the groove. The fulcrum plate then pivots around the other shaft until it falls completely away from that other shaft and from between the side plates.

8 Claims, 2 Drawing Figures

RELEASABLE CONNECTOR HAVING IMPROVED LOAD CARRYING AND RELEASING CAPABILITY

This invention relates to a releasable connector mechanism, and more particularly to a releasable connector mechanism for releasing extremely heavy loads such as a heavy sea anchor and anchor chain. The mechanism is adapted for use as a remotely actuated release mechanism.

In my U.S. Pat. No. 3,602,959, issued Sept. 7, 1971, I disclosed a releasable connector for automatically releasing a load in response to a command signal transmitted from a remote location. That releasable connector is quite useful and has been extensively used. However, the weight of the load that can be carried and released by that mechanism is limited and it cannot be used to carry and release very heavy loads such as heavy sea anchors and anchor chains whose weight might be as high as 200,000 pounds, for example.

The present invention employs the releasable connector of my above-mentioned patent in cooperation with additional load carrying and releasing mechanisms to provide a releasable connector that has much greater load carrying and releasing capabilities.

Although the releasable connector of this invention has many uses its use later will be described in connection with the setting of very large anchors which are attached by heavy anchor chains to a well drilling barge which is to be positioned at a desired location on the ocean. In this type of a situation the anchor chain is secured to the barge and the anchor and remaining portion of the chain is located on a work boat. The work boat maneuvers to a predetermined site away from the barge where the anchor is to be set. The releasable connector of this invention is attached to an anchor chain link near the anchor and a tether line attached to a winch on the work boat is secured to the releasable connector. The releasable connector, anchor and anchor chain are put over the side or stern of the boat and lowered until the anchor is at or slightly above the bottom. An acoustic common signal then is transmitted from the work boat, or elsewhere, to command the releasable connector to release the anchor chain and anchor. Many anchors are set about the barge in this manner.

BRIEF DESCIPTION OF THE DRAWINGS

The invention will be described by referring to the accompanying drawings wherein:

FIG. 1 is a vertical partial sectional view of the improved releasable connector of this invention; and FIG. 2 is an isometric view, partially in phantom and partially broken away, further illustrating the improved releasable connector of this invention.

DETAILED DESCRIPTION OF THE DRAWINGS

Figure 2:
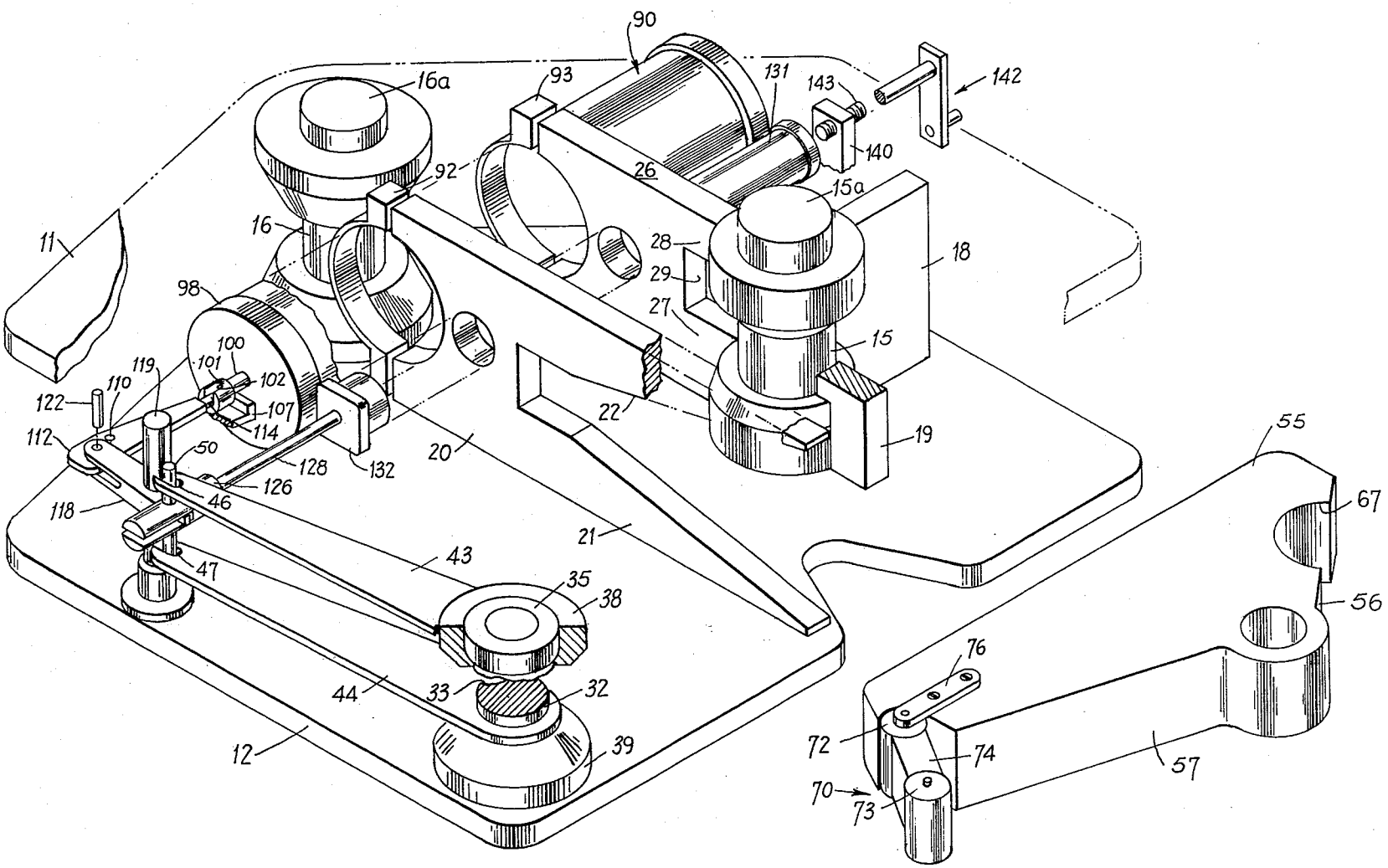

Referring in detail to the drawings, the apparatus is comprised of first and second heavy metal side plates 11 and 12 disposed in fixed parallel relationship. The plates are maintained in spaced relationship by transversely extending thick shafts 15 and 16 whose opposite ends 15*a* and 16*a*, FIG. 2, are secured as by welding to apertures in the two side plates 11 and 12. A tether line 17 is secured about shaft 16.Thick steel reinforcing plates 18 and 19 are welded to the right side and bottom, respectively, of shaft 15 and are also welded to the opposite side plates 11 and 12.

A first bulkhead 20 located generally midway between opposite sides of plates 11 and 12 is welded to the inner surfaces of the plates. Bulkhead 20 has spaced legs 21 and 22 at its lower end to provide a free space therebetween for reasons that will be explained below.

A second bulkhead 26 similar in shape to bulkhead 20 is secured between plates 11 and 12 in the region above shaft 15. Legs 27 and 28 of bulkhead 26 are shorter than legs 21 and 22 of bulkhead 20, and provide a free space 29 therebetween.

A freely rotatable cam shaft 32 is supported between a pair of sealed roller bearings 35 and 36. The outer races of the roller bearings are secured to respective clamping means 38 and 39 which in turn are bolted to the respective side plates 11 and 12. Cam shaft 32 has a concave cylindrical cam surface or groove 33 extending longitudinally along its outer surface at a predetermined angular position thereon.

A pair of parallel spaced pivot arms 43 and 44 are secured at their lower ends to freely rotatable cam shaft 32 and are rotatable with the shaft 32. The upper ends of pivot arms 43 and 44 are forked, as at 46 and 47, respectively, to receive a release cross shaft 50 which will be discussed in detail below.

A thick metal releasable fulcrum plate 55 is somewhat triangular in shape but its side 56 is shorter than its side 57. A thick retaining pin 60 extends through the bottom portion of releasable fulcrum plate 55 in the region of the apex of the inverted triangular shape. As seen in the drawings, side plates 11 and 12 are recessed along their bottom edges to be clear of retaining pin 60.

A shackle 62 is secured to fulcrum plate 55 by the retaining pin 60, and a link 64 of an anchor chain may be connected to shackle 62.

In the armed condition of the releasable connector mechanism of this invention, wherein the anchor chain 64 is being retained, fulcrum plate 55 is releasably supported within side plates 11 and 12 in the following manner. A concave cylindrical surface 67 formed in the shorter side 56 of the fulcrum plate is of complementary shape to shaft 15 and is in pivotable engagement with the top and left portions of shaft 15.

A swinging latch 70 located on the left side of fulcrum plate 55 is comprised of cylindrical metal bars 72 and 73 which are welded to a heavy metal block 74 whose ends are shaped to conform to the surfaces of bars 72 and 73. Swinging latch 70 is pivotally attached to fullcrum plate 55 by a pair of retaining bars 76 that are bolted to opposite sides of fulcrum plate 55. Pivot pin 78 passes axially through cylindrical bar 72 and its two ends are retained in oversized holes 79 in the respective retaining bars 76. The cylindrical bars 72 and 73 at opposite ends of swinging latch 70 are received within the concave cylindrical surfaces 69 and 33 in fulcrum plate 55 and rotatable cam shaft 32, respectively. The lower cylindrical rod 73 of swinging latch 70 has axially extending keeper pins 81 on each end. These pins 81 are received within U-shaped notches 82 in each of the pivot arms 43 and 44. Keeper pins 81 mating with notches 82 help maintain the lower cylindrical bar 73 within the cylindrical cam surface 33 of fulcrum plate 55, and thus maintain swinging latch 70 and cam shaft 32 in predetermined relationship with respect to each other when releasable fulcrum plate 55 is in its retained position illustrated in FIG. 1. In this predetermined relationship a construction line 85 passing through the longitudinal center axis of swinging latch 70 passes through the center of cam shaft 32. This means that in the retained position of fulcrum plate 55 illustrated in FIG. 1, the portion of the load of the fulcrum plate, anchor chain 64 and anchor that is carried by swing latch 70 is transferred through swinging latch 70 and is applied radially to the cam shaft 32. Consequently, there is little or no torque applied to cam shaft 32 by the load and little or no tendency for cam shaft 32 and pivot arms 43 and 44 to rotate and pivot due to that load.

It is seen that retaining pin 60 and shackle 62 are located closer to thick shaft 15 than they are to swinging latch 70. Consequently, a major portion of the load coupled to shackle 62 is carried by the thick shaft 15 and a minor portion is carried by swinging latch 70.

It also will be noted that the concave cylindrical surface 67 in the short leg 56 on the right side of fulcrum plate 55 engages the top and left side of the thick shaft 15. Considering this feature in connection with swinging latch 70 it will be seen that the weight of fulcrum plate 55, anchor chain 64 and the anchor acting on the swinging latch will tend to pivot the latch in a clockwise direction. However, because swinging latch 70 is an extremely rigid member, any tendency for it to pivot clockwise will tend to move fulcrum plate 55 to the right. Because heavy shaft 15 is in engagement with concave cylindrical surface 67 of the fulcrum plate, the fulcrum plate cannot move. This in turn means that swinging latch 70 is in effect latched since it cannot rotate in the counterclockwise direction because fulcrum plate 55 and heavy shaft 15 will not permit it. The weight of the fulcrum plate, anchor chain, and anchor will prohibit any counterclockwise motion of swinging latch 70. To assure the latching action just described, the vertical surface 86 on the left side of the fulcrum plate 55 adjoins the concave cylindrical surface 69 and helps retain the cylindrical bar 72 of swinging latch 70 in its latched positon.

Apparatus for maintaining pivot arms 43 and 44 in the armed or retained position illustrated in FIG. 1 now will be described. An acoustically responsive releasable connector 90 of the type described in my above-mentioned U.S. Pat. No. 3,602,959 includes an enclosed, water tight, tubular casing 91 which is mounted in the top cylindrically concave portions of bulkheads 20 and 26. The casing 91 is secured in place by means of respective clamps 92 and 93 which are bolted to the tops of the respective bulkheads. An acoustic transducer 95 is located near the right end of casing 91 and a conduit 96 contains electrical wires that extend from the transducer to electronic circuitry within the tubular casing 91 of the releasable connector 90. As described in my patent, a locking and release mechanism located within the left end of tubular casing 91 includes a rotatable shaft 100 that extends axially through the end cap 98 at the left end of the casing. Shaft 100 terminates in an enlarged collar 101 which has an open ended slot 102 at its outer end.

A clevis member 105 is secured to end cap 98 and includes a pair of spaced parallel legs 107 which have holes 108 therein for receiving a clevis pin 110 therebetween. A clevis hook 112 is rotatably mounted on pin 110 and terminates at its right end in a head 114 which is releasably held in the open ended slot 102 when the releasable connector 90 is in its armed condition. Clevis hook 112 also includes a retaining notch 116 near its left end.

As explained in my patent, upon receipt of an acoustic command signal by transducer 95, electronic circuitry within casing 91 responds thereto to produce a corresponding release command signal. The locking and release mechanism responds to the command signal to cause shaft 100 and collar 101 to rotate 90 °. This places open ended slot 102 in the vertical position so that the head 114 on the end of clevis hook 112 is free to pivot out of collar 101.

A release pivot arm 118 is mounted on a pivot shaft 119 that is mounted between side plates 11 and 12. As best seen in FIG. 2, release pivot arm 118 is bifurcated at its top to permit clevis hook 112 to pass therethrough. The arms at the bifurcated end of release pivot arm 118 are apertured to retain a latch pin 122 therebetween. In the armed condition illustrated in FIG. 1, latch pin 122 extends through the notch 116 at the left end of clevis hook 112. The lower end of release pivot arm 118 terminates in a latch finger 123 which is held against the right side of cross shaft 50.

Cross shaft 50 extends through the two ends of a bifurcated head 126 that is secured to a spring biased shaft 128. Shaft 128 extends axially through the left end of a cylinder 131 which is closed at its left end by an apertured plug 132. One or more heavy helical springs 134 are disposed about shaft 128 within cylinder 131. A washer 137 and a nut 138 at the right end of shaft 128 keep the helical spring 134 on the shaft.

Beyond the right end of cylinder 131 a threaded block 140 is welded between side plates 11 and 12. A screw jack 142 having a threaded shaft 143 is adapted to be threadably received in the aperture of block 140. Threaded shaft 143 is sufficiently long so that when it is threaded through block 140 it will engage the right end of spring biased shaft 128 within cylinder 131. Upon the clockwise turning of screw jack 142, shaft 128 will be pushed to the left against the force of helical spring 134 until the bifurcated head 126 can be moved to the position illustrated in full lines in FIG. 1.

In describing the operation of the heavy duty releasable connector mechanism of this invention, it first will be assumed that the mechanism is in its unprepared condition in which releasable fulcrum plate 55 is removed from between side plates 11 and 12 and that the anchor chain 64 has not yet been attached to shackle 62. Pivot arms 43 and 44, as well as concave cam or groove 33 in cam shaft 32, are rotated clockwise from their positions illustrated in FIG. 1. Cross shaft 50 is withdrawn from the bifurcated head 126 on spring biased shaft 128. It further will be assumed that screw jack 142 is withdrawn from block 140 and spring 134 is in its least compressed condition. Shaft 128 and bifurcated head 126 will be in their extreme right positions. Additionally, it is assumed that acoustically responsive releasable connector 90 is in its armed condition in which open ended slot 102 on collar 101 is extending horizontally. Furthermore, clevis pin 110 is removed from the two parallel legs 107 and clevis hook 112 is removed.

Assuming now that the device is to be prepared for use as it would be on the deck of a ship or, on a barge or platform at sea, the procedure would be substantially as follows. Screw jack 142 is inserted into the threaded aperture in block 140 and is turned to engage spring biased shaft 128. Screw jack 142 is turned to move bifurcated head 126 on the left end of shaft 128 to the position illustrated in FIG. 1. The screw jack is maintained in its inserted position to hold shaft 128 against the force of the now compressed heavy helical spring, or springs, 134.

Releasable fulcrum plate 55 now is inserted between side plates 11 and 12 and between legs 21 and 22 of bulkhead 20 and between legs 27 and 28 of bulkhead 26. The right side of fulcrum plate 55 is inserted first to bring its concave cylindrical surface 67 into pivotal engagement with the thick shaft 15. Fulcrum plate 55 then is pivoted in a closkwise direction about shaft 15 to raise its left side, and the cylindrical bar 73 on the bottom of swinging latch 70 is placed in the concave cam surface 33 in cam shaft 32. Pivot arms 43 and 44 then are rotated counterclockwise to bring them into the positions illustrated in FIG. 1. The rotation of pivot arms 43 and 44 also rotates cam shaft 32 and causes swinging latch 70 to assume its latched condition that was described above.

Figure 1:
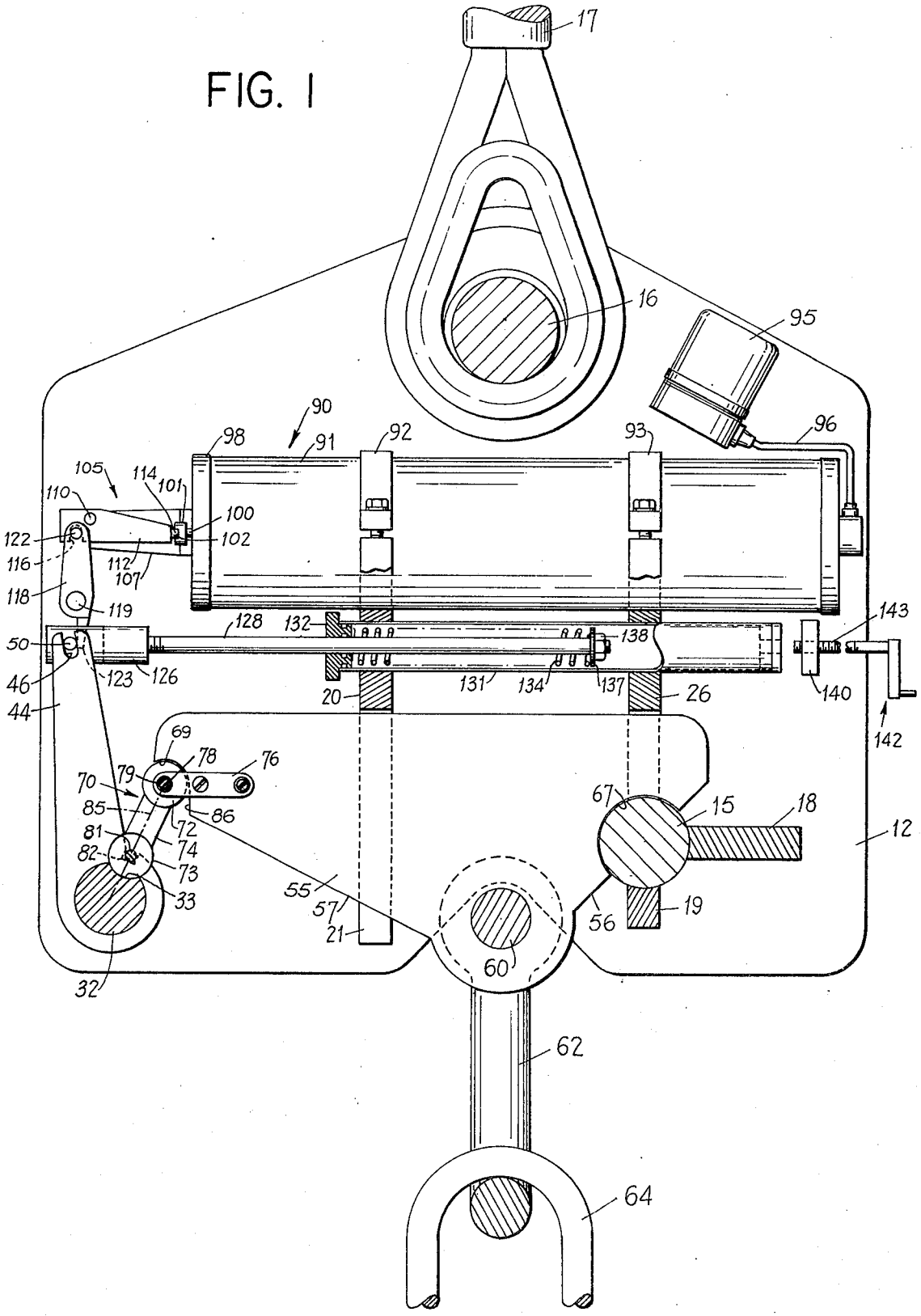

Release pivot arm 118 is rotated to the position illustrated in FIG. 1, and the right end of clevis hook 112 is inserted into the open end of collar 101. The notch 116 at the left end of clevis hook 112 is placed in capturing engagement with the latch pin 122 that extends across the bifurcated top of release pivot arm 118. The head 114 on the right end of clevis hook 112 is placed in collar 101 and clevis pin 110 is inserted through parallel plates 107 and the aperture in clevis hook 112.

Now, cross shaft 50 is inserted through the forked ends 46 and 47 of pivot arms 43 and 44 and through the apertures in head 126 on spring biased shaft 128. Because acoustically responsive releasable connector 90 is in its armed, or cocked, condition, clevis hook 112 holds release pivot arm 118 against rotation and its latch finger 123 holds cross shaft 50, and thus head 126, shaft 128 and pivot arms 43 and 44, in the respective positions illustrated in FIG. 1.

Because the load acting through swinging latch 70 acts radially through cam shaft 32, as described above, there will be little or no rotational force applied by pivot arms 43 and 44 to the cross shaft 50 or to latch finger 123 of release pivot arm 118. Thus, the acoustically responsive releasable connector 90 needs to have a retaining ability sufficient to overcome only the force that compressed helical spring 134 applies to shaft 128. Of course, a reasonable safety factor will be included.

Screw jack 142 now may be withdrawn, anchor chain 64 may be attached and the apparatus is ready to be dropped into the sea to hold the anchor chain to the tether line 17.

For the description of the release of fulcrum plate 55 and its load, it will be assumed that a drilling barge is at a desired location in the ocean where drilling is to be conducted. Very large anchors with their chains are to be deployed on the ocean floor about the desired location to keep the barge in positon. A work boat carries the anchor and chain to a predetermined site away from the barge. The releasable connector apparatus of this invention is attached to the anchor chain and the apparatus, anchor and chain are lowered into the ocean. When the anchor is on the bottom, or suspended slightly above the bottom, at the predetermined site, an acoustic command signal is transmitted from the work boat to the apparatus to command the release of the anchor chain.

The command signal is received by acoustic transducer 95 and a corresponding signal is transmitted to electronic circuitry in the automatically releasable connector 90 of my prior patent. The device operates to cause shaft 100 and collar 101 to rotate ninety degrees to place open ended slot 102 in a vertical plane. Head 114 on the end of clevis hook 112 now is free to disengage from collar 101. Because of the spring bias on shaft 128 and head 126, the release cross shaft 50 acting on release finger 123 tries to rotate release pivot arm 118 and its latch pin 122 in a counterclockwise direction about pivot shaft 119. With the head 114 of clevis hook 112 now free to escape from collar 101, the clevis hook 112 will be rotated in a clockwise about clevis pin 110 by the force applied by cross shaft 50. Spring 134 acting through shaft 128 continues to pull cross shaft 50 in head 126 to the right and thus further rotate release pivot arm 118 in a counterclockwise direction and clevis hook 112 in a clockwise direction. At a predetermined counterclockwise rotation of release pivot arm 118, latch pin 122 will escape from notch 116 in clevis hook 112 and spring loaded shaft 128 will rapidly pull head 126 and cross shaft 50 to the right. Nothing now is restraining release pivot arm 118 so that cross shaft 50 pivots it out of the way.

As cross shaft 50 moves to the right under the force supplied by the expanding spring 134, it pivots pivot arms 43 and 44 in a clockwise direction. Cam shaft 32 rotates in a clockwise direction so that the load applied thereto through swinging latch 70 no longer is acting wholly radially on the cam shaft. Therefore, the load applied through swinging latch 70 now applies a clockwise torque to cam shaft 32 to further rotate the cam shaft and pivot arms 43 and 44 attached thereto. The more that cam shaft 32 rotates the greater will be the torque acting to rotate it. Cam shaft 32 and pivot arms 43 and 44 continue to rotate clockwise with increasing speed until the concave cam surface 33 reaches a predetermined angular position which permits cylindrical bar 73 on the bottom of swinging latch 70 to slide out from cam surface 33.

Releasable fulcrum plate 55 then is free on its left side and will begin to pivot in a counterclockwise direction around the thick shaft 15 and will begin to fall away from between side plates 11 and 12. The weight of the anchor chain will continue to pull fulcrum plate 55 in a counterclockwise direction until it has rotated far enough to fall away from the thick shaft 15. Fulcrum plate 55 now is completely released and falls with the anchor chain completely free of the remainder of the apparatus between side plates 11 and 12. This remaining apparatus now may be retrieved by the work boat.

As best seen in FIG. 2, as pivot arms 43 and 44 rotate clockwise during the release operation, they will pass between legs 21 and 22 of bulkhead 20 and are spaced apart a sufficient distance to pass on the outside of fulcrum plate 55, latch members 76 and swinging latch 70 before the fulcrum plate 55 completely falls away.

Upon the release of fulcrum plate 55, the pivot arms 43 and 44 will freely rotate by means of the roller bearings that support cam shaft 32. The sea water will of course act as a damper to the free rotation of the pivot arms after fulcrum plate 55 is released. But should they rotate more than 360 °, there is nothing to interfere with their rotation.

In one embodiment of the apparatus that was designed to carry and release a 100 ton load, side plates 11 and 12 were 1.5 inches thick, shaft 15 was 4.5 inches thick, and shaft 16 was 5.0 inches thick. Cam shaft 32 was 3.5 inches thick and retaining pin 60 for shackle 62 was 3 inches thick. The weight of the apparatus was approximately 1 ton, exclusive of load.

The apparatus is relatively simple to fabricate. The shapes of existing stock materials are utilized throughout and difficult machining operations are minimized. The use of concave cylindrical pivot surfaces not exceeding 180° in circumferential extent not only simplifies the fabrication of the apparatus but provides the pivoting action and allows the complete fall away feature of fulcrum plate 55 with respect to thick shaft 15 and of swinging latch 70 with respect to cam shaft 32.

The overall height of side plates 11 and 12 is approximately 37.5 inches so that the apparatus is relatively short for devices of this type. This shorter height considerably simplifies the operation of deploying it over the side of a boat and over a sheave or similar apparatus for paying out the tether line 17 attached to it.

In its broader aspects, this invention is not limited to the specific embodiment illustrated and described. Various changes and modifications may be made without departing from the inventive principles herein disclosed.

I claim:

1. In a releasable connector apparatus the combination comprising, first and second rigid side plates, means including first and second shafts for maintaining said side plates in spaced parallel relationship, means extending between said side plates for attaching said apparatus to support means, said first and second shafts extending between the side plates at respective regions on opposite sides of a transverse plane through the central regions of the side plates, the second one of the shafts being freely rotatable, pivot arm means extending outwardly from the second shaft and between the side plates, a fulcrum plate having a pivot means on one end region for pivotally engaging the top region and one side region only of the first shaft, said pivot means permitting disengagement of the fulcrum plate from the first shaft upon pivotal rotation of the fulcrum plate by a given angle in a given direction, the fulcrum plate having a length to pass freely by the second shaft when it pivotally rotates through said given angle in said given direction, a cam surface in the second shaft, elongated latch means pivotally engaging said cam surface on one end and pivotally engaging the opposite end of the fulcrum plate, means for attaching a load to the fulcrum plate at a location thereon closer the first shaft than the second shaft, whereby the first shaft carries a major portion of said load, said latch means releasably supporting the opposite end of the fulcrum plate on said second shaft and the cam surface in the second shaft being angularly positioned to receive the weight of the load transmitted thereto in a direction substantially only radial, whereby said load produces substantially no rotational force on the second shaft, spring loaded means coupled to the outward end of the pivot arm means for applying a force to rotate the pivot arm means toward the fulcrum plate and rotate the second shaft to disengage the latch means therefrom, releasable restraining means for restraining said spring loaded means and thus preventing rotation of the pivot arm means, and release means operable to release said releasable restraining means for permitting said spring loaded means to rotate the pivot arm means and rotate the cam surface by an angle sufficient to cause the latch means to freely release from the cam surface, said fulcrum plate being pivoted in said given direction about the first shaft by the load upon release of the latch means and pivoting through said given angle to fall free of the first shaft and away from the side plates.

2. A releasable connector for suspending a load and for automatically releasing said load upon command, comprising a pair of rigid, spaced apart side plates adapted to be vertically suspended, means including first and second shafts extending transversely between said side plates and supported thereby, said two shafts being on opposite sides of a vertical plane extending transversely through the central regions of the side plates, the second one of the shafts being rotatably supported between said side plates and having a concave cylindrical groove at a predetermined angular location on its surface, at least one pivot arm secured to the second shaft for rotation therewith and extending outwardly therefrom, an elongated releasable fulcrum plate adapted to be positioned between said side plates and to be pivotally supported in a completely releasable manner at its opposite end regions by said two shafts, a concave pivot surface on one side of the fulcrum plate for pivotally engaging the first shaft at its top portion and at its side portion nearest the second shaft, whereby the first shaft supports one end of the fulcrum plate and prevents displacement of the fulcrum plate in a direction away from the second shaft, said concave surface permitting automatic disengagement of the fulcrum plate from the first shaft upon pivoting of the fulcrum plate about the first shaft by a given angle in the direction going directly from the top to said side portion of the first shaft, a second concave pivot surface at the opposite end region of the fulcrum plate, a latch member having a first surface for pivotally engaging said second concave pivot surface of the fulcrum plate and a second surface for pivotally and releasably engaging the cylindrical groove in the second shaft, said cylindrical groove being positioned at an angular position relative to said opposite end region of the fulcrum plate so that a portion of the weight of the fulcrum plate is transferred through the latch member and acts substantially wholly in a radial direction on the second shaft, means for rotating said pivot arm in a direction toward said fulcrum plate to rotate the groove in the second shaft in a direction to cause the weight of the fulcrum plate acting through the latch member to further rotate the pivot arm and second shaft to an angular position where the second surface of the latch member will freely disengage from said groove in the second shaft, means for suspending a load from the fulcrum plate at regions thereon closer to said first shaft than said second shaft, whereby the first shaft bears the greater portion of said load, said fulcrum plate having a length to permit it to pivot about the first shaft and past the second shaft under the weight of the load when said latch member falls away from the groove.

3. A releasable connector particularly adapted to suspend and release, when desired, a heavy load, comprising first and second spaced parallel side plates adapted to be vertically suspended, means including first and second shafts extending transversely between said plates for maintaining the side plates in fixed parallel relationship, said two shafts being on opposite sides of a vertical plane extending transversely through the center regions of the parallel side plates, the second one of said shafts being rotatably supported between said side plates and having a cam surface extending longitudinally along its surface at a predetermined angular location thereon, said cam surface being substantially symmetrical with respect to a line passing through the center of the second shaft, a pair of spaced apart pivot arms secured to the second shaft and extending upwardly toward the top portions of the side plates at a fixed angular relationship with respect to said cam surface, a generally triangular shaped fulcrum plate adapted to be positioned between said side plates with the apex of the triangle toward the bottom of the side plates, said fulcrum plate having one shorter side and one longer side with the apex included therebetween, a pivot surface in the shorter side of said fulcrum plate for pivotally supporting one end of the fulcrum plate on the first one of said shafts, a second pivot surface in the longer side of the fulcrum plate, an elongated swinging latch having on one end a pivot surface pivotally engagable with said cam surface and having on its opposite end a pivot surface pivotally engagable with the second pivot surface in the longer side of the fulcrum plate, said swinging latch being positioned to releasably support the other end of the fulcrum plate on said second shaft, said second shaft being rotated so that the elongated swinging latch is aligned with the center of the second shaft, spring loaded means supported between said side plates and releasably attached to the free ends of the pivot arms for applying a force to the free ends of the pivot arms to tend to rotate the pivot arms toward the interior region of the parallel plates, a pivotable rocker arm supported between the side plates and having means to hold said pivot arms against said spring force when the rocker arm is in a first latching position and to free the pivot arms for rotation by the spring force when the rocker arm is pivoted to a second unlatched position, latching means for maintaining the pivotable rocking arm in said first latching position and for releasing it to its second unlatched position, means for operating said latching means to latch and unlatch the rocker arm, means on said fulcrum plate adjacent said apex for suspending a load thereto, said fulcrum plate having a length to permit its other end to pivot past the second shaft when the second shaft is rotated to cause the pivot surface on said one end of the swinging latch to fall out of the cam surface of the second shaft under the force of said load.

4. The combination claimed in claim 3 wherein said first and second shafts are cylindrical in shape and wherein said pivot surface in the shorter side of the fulcrum plate is a concave cylindrical surface not greater than 180°, said concave cylindrical surface in the shorter side of the fulcrum plate engaging the first shaft on its top portion and the side portion nearest the second shaft when the fulcrum plate is in its supported position on the two shafts.

5. The combination claimed in claim 4 wherein said swinging latch is comprised of first and second cylindrical members joined by a spacing member, said cylindrical members having their axes transverse to the side plates and the spacing member being symmetrical with respect to a plane through the axes of the cylindrical members.

6. The combination claimed in claim 5 wherein said cam surface is a concave cylindrical surface of less than 180° for receiving a cylindrical member of the swinging latch.

7. The combination claimed in claim 6 wherein the second pivot surface in the longer side of the fulcrum plate is a concave cylindrical surface less than 180° for receiving the other cylindrical member of the swinging latch.

8. The combination claimed in claim 3 and further including means on the fulcrum plate for retaining the swinging latch in pivotal relationship with the pivot surface in the longer side of the fulcrum plate.

* * * * *